US008057019B2

(12) United States Patent
Takahashi

(10) Patent No.: US 8,057,019 B2
(45) Date of Patent: Nov. 15, 2011

(54) LIQUID EJECTION APPARATUS AND INITIAL FILLING METHOD OF THE SAME

(75) Inventor: Masaru Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1061 days.

(21) Appl. No.: 11/701,059

(22) Filed: Jan. 31, 2007

(65) Prior Publication Data

US 2007/0188563 A1 Aug. 16, 2007

(30) Foreign Application Priority Data

Feb. 1, 2006 (JP) ..... P2006-024151
Jan. 26, 2007 (JP) ..... P2007-016785

(51) Int. Cl.
*B41J 2/175* (2006.01)

(52) U.S. Cl. ..... 347/85; 347/84; 347/86

(58) Field of Classification Search ..... 347/84, 347/85, 86

See application file for complete search history.

(56) References Cited

U.S. PATENT DOCUMENTS

| | | | | |
|---|---|---|---|---|
| 6,585,358 | B2 * | 7/2003 | Usui et al. | 347/85 |
| 2004/0150695 | A1 * | 8/2004 | Diaz-Felipe | 347/85 |
| 2005/0285913 | A1 * | 12/2005 | Yoshino et al. | 347/85 |

FOREIGN PATENT DOCUMENTS

| | | |
|---|---|---|
| JP | 2001-219574 | 8/2001 |
| JP | 2003-237100 | 8/2003 |

* cited by examiner

*Primary Examiner* — Laura Martin
(74) *Attorney, Agent, or Firm* — Nutter McClennen & Fish LLP; John J. Penny, Jr.; Christina M. Sperry

(57) ABSTRACT

A liquid ejection apparatus including an ejection head having a nozzle in which liquid is ejected through the nozzle, a plurality of cartridges that retain the liquid and supplies the liquid to the ejection head, and a switching mechanism that switches liquid to be supplied to the ejection head from a plurality of types of liquid supplied from the cartridges. The switching mechanism includes a body having a communication passage in communication with the ejection head, a first diaphragm chamber and a second diaphragm chamber that communicate with each other through the communication passage and located to facing each other, a first diaphragm and a second diaphragm arranged in the first diaphragm chamber and the second diaphragm chamber, respectively, and capable of opening and closing the communication passage, and an operation mechanism provided in the communication passage. The operation mechanism includes a first operation end and a second operation end that operate the first diaphragm and the second diaphragm, respectively, when the communication passage is opened to allow communication between at least one of the first and second diaphragm chambers and the ejection head, and an urging member that urges the first and second operation ends in a direction in which the communication passage is opened by the first and second diaphragms.

15 Claims, 13 Drawing Sheets

As Viewed in Direction W2

As Viewed in Direction W1

LIQUID EJECTION APPARATUS AND INITIAL FILLING METHOD OF THE SAME

CROSS-REFERENCE TO RELATED APPLICATIONS

This application is based upon and claims the benefit of priority from prior Japanese Patent Applications No. 2006-024151, filed on Feb. 1, 2006, and No. 2007-016785, filed on Jan. 26, 2007, the entire contents of which are incorporated herein by reference.

BACKGROUND

1. Technical Field

The present invention relates mainly to a liquid ejection apparatus used as an inkjet type recording apparatus that forms dots on a recording medium by ejecting ink droplets from nozzles in accordance with printing data and a method of initial filling of the liquid ejection apparatus.

2. Related Art

As a liquid ejection apparatus that ejects liquid onto a target, an inkjet type recording apparatus that performs printing by ejecting ink onto a recording paper sheet is known. This type of apparatus suppresses noise generated through printing to a relatively low level and is capable of forming small-sized dots at a high density. Therefore, an inkjet type recording apparatus is now frequently used for printing including color printing. Such apparatus includes an inkjet type printing head and a paper feeder mechanism. Ink is supplied from an ink cartridge to the printing head. The paper feeder mechanism transports a recording medium in a direction perpendicular to the scanning direction of the printing head.

The inkjet type recording apparatus performs recording by ejecting ink droplets onto the recording medium through mechanical pressure or thermal energy applied to the printing head while moving the printing head mounted in a carriage along the width of the recording medium (in the main scanning direction). Specifically, a printing head that ejects, for example, black ink and different color inks such as yellow, cyan, and magenta inks is mounted in the carriage of the inkjet type recording apparatus. The recording apparatus performs not only text printing using the black ink but also full-color printing by changing the ejecting proportion of the inks.

Further, to improve the quality of the color printing, a recording apparatus employing ink of a total of six colors, including black, has been developed. The six colors include light cyan, and light magenta as well as the aforementioned colors. Also, there is a demand for an inkjet type recording apparatus capable of performing large-scale printing on large-sized sheets of paper without replacing ink cartridges. In these cases, ink cartridges with increased capacities become necessary for supplying ink to the recording heads. To satisfy the demand, a recording apparatus configured as will be described in the following has been developed. Specifically, for example, ink cartridges are removably mounted not in a carriage but in cartridge holders arranged in securing portions formed at opposite side portions of the body of the apparatus. Ink is supplied from each of the cartridge holders to a printing head through, for example, a flexible tube and an ink supply passage.

This inkjet type recording apparatus can be applied to various types of printing through ejection of ink droplets from nozzle openings of the printing head. The ink cartridges are replaceable in accordance with the purposes for printing. In other words, if printing needs to be carried out with inks of different types than the inks retained in the currently mounted ink cartridges, the ink cartridges are temporarily separated from the apparatus and replaced by ink cartridges retaining desired types of ink. This structure leads to frequent demands for printings of different printing qualities using different types of inks in the same printer.

However, replacement of the ink cartridges is troublesome for the user of the recording apparatus. If an increased number of cartridges needs to be replaced, such troublesome user operation must be repeated a number of times. In a printing apparatus described in JP-A-2003-237100, the types of ink ejected from corresponding nozzle rows can be changed without replacing ink cartridges. Nonetheless, the apparatus does not allow such switching of the ink types in correspondence with the nozzle rows and is not applicable to a case in which the ink types must be switched in correspondence with the nozzle rows.

JP-A-2001-219574 describes a switch structure that allows switching of ink cartridges in correspondence with nozzle rows. However, the switch structure switches the ink cartridges, which are connected to the nozzle rows. Specifically, the number of ink cartridges that are simultaneously connected to each of the nozzle rows is always one. This makes it necessary to perform initial ink filling for each of the ink cartridges before the ink cartridges are initially used, which is disadvantageous. Further, in the recording apparatus having the above-described switch structure, there may be a case in which only one of the cartridges is used. In this case, bubbles may be generated in a corresponding ink passage, leading to a defect in ink ejection.

SUMMARY

Accordingly, it is an objective of the present invention to provide a liquid ejection apparatus and an initial filling method of the liquid ejection apparatus that allow simultaneous initial filling for multiple cartridges.

In accordance with one aspect of the present invention, a liquid ejection apparatus having an ejection head, a plurality of cartridges, and a switching mechanism is provided. The ejection head has a nozzle in which liquid is ejected through the nozzle. The cartridges retain the liquid and supply liquid to the ejection head. The switching mechanism switches liquid to be supplied to the ejection head from a plurality of types of liquids supplied from the cartridges. The switching mechanism includes a body, a first diaphragm chamber and a second diaphragm chamber, a first diaphragm and a second diaphragm, and an operation mechanism. The body has a communication passage in communication with the ejection head. The first and second diaphragm chambers communicate with each other through the communication passage and located facing each other. The first and second diaphragms are arranged in the first diaphragm chamber and the second diaphragm chamber, respectively. The first and second diaphragm are each capable of opening and closing the communication passage. The operation mechanism is provided in the communication passage. The operation mechanism includes a first operation end and a second operation end, and an urging member. The first and second operation ends operate the first diaphragm and the second diaphragm, respectively, when the communication passage is opened to allow communication between the ejection head and at least one of the first and second diaphragm chambers. The urging member urges the first and second operation ends in a direction in which the communication passage is opened by the first and second diaphragms.

In accordance with another aspect of the present invention, an initial filling method of the above mentioned liquid ejection apparatus is provided. According to this method, initial filing of the liquid is performed in a state in which the first and second operation ends are urged in the direction in which the communication passage is opened by the first and second diaphragms.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF EXEMPLARY EMBODIMENTS

Figure 1:
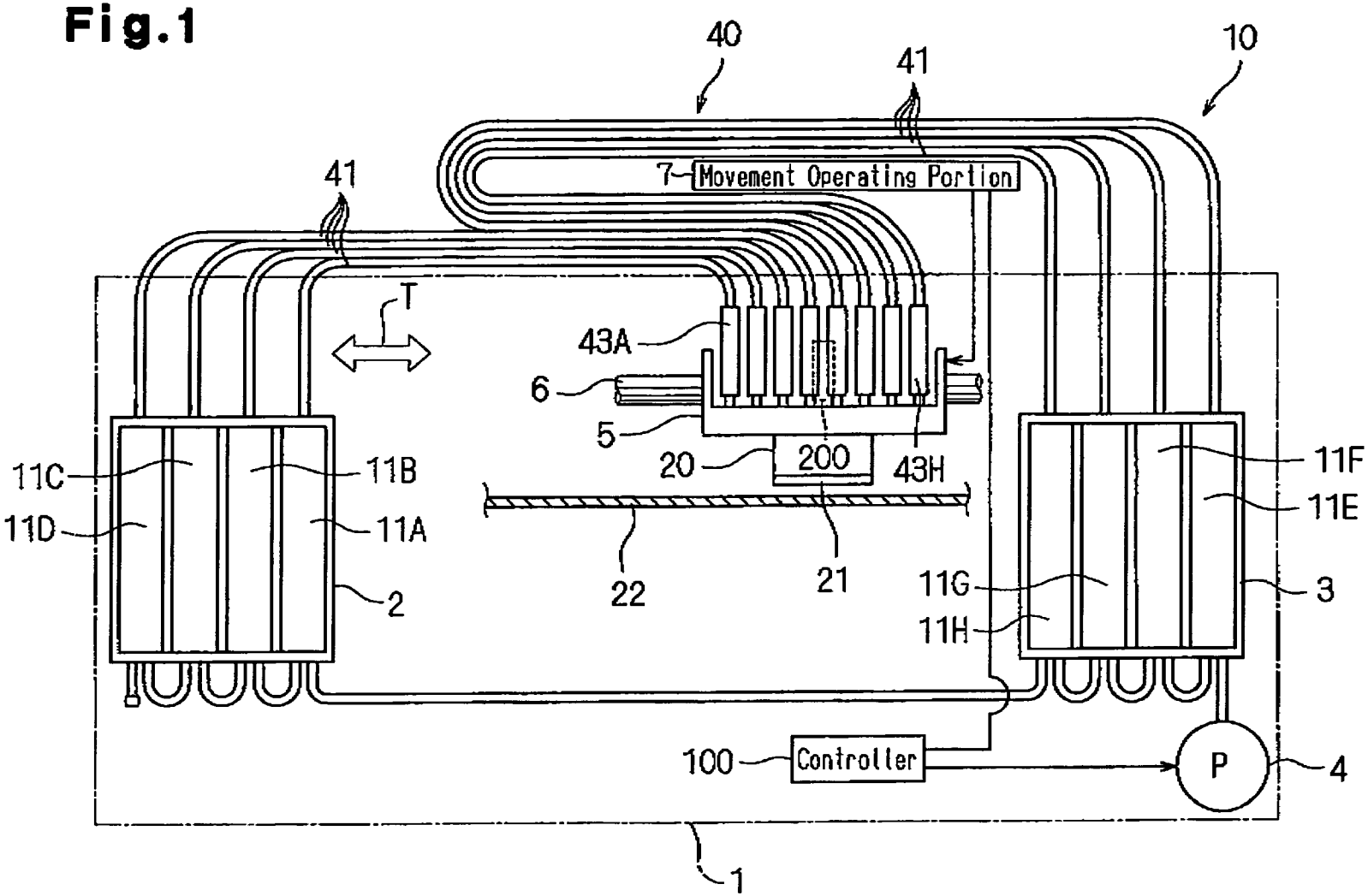
FIG. 1 is a view showing an inkjet type recording apparatus according to an embodiment of the present invention.

An embodiment of the present invention will now be described with reference to the attached drawings. FIG. 1 shows an inkjet type recording apparatus 10, or a liquid ejection apparatus of the present invention. The inkjet type recording apparatus 10 is referred to as an inkjet printer. The inkjet type recording apparatus 10 has a body 1. The body 1 has two cartridge holders 2, 3, a pressure pump 4, a carriage 5, a recording head 20, a guide shaft 6, a movement operating portion 7, a liquid supply passage portion 40, and a controller 100.

A cartridge holder 2 and a cartridge holder 3 accommodate a plurality of ink cartridges 11A to 11H as cartridges. As shown in FIG. 1, each of the cartridge holders 2, 3 of the illustrated embodiment receives four ink cartridges. A total of eight ink cartridges 11A to 11H are mounted in the body 1. The ink cartridges 11A to 11H retain, for example, cyan, magenta, yellow, matte black, photo black, light cyan, light magenta, and gray ink, respectively.

In the illustrated embodiment, the ink cartridge 11D retains matte black ink (MB) and the ink cartridge 11E retains photo black ink (PB). The ink cartridges 11A to 11H are accommodated in the cartridge holders 2, 3 instead of being mounted directly in the carriage 5. That is, the inkjet type recording apparatus 10 is an off-carriage type inkjet printer.

The pressure pump 4 applies pressure to the ink cartridges 11A to 11H by supplying compressed air to the cartridge holders 2, 3. This supplies the ink from the ink cartridges 11A to 11H to the recording head 20 of the carriage 5 through the liquid supply passage portion 40.

The guide shaft 6 extends horizontally with respect to the body 1. Through operation of the movement operating portion 7, the carriage 5 is reciprocated on the guide shaft 6 along the main scanning direction T of the carriage 5 and thus positioned. The movement operating portion 7 has, for example, a non-illustrated motor and a non-illustrated synchronous belt driven by the motor. The synchronous belt is secured to the carriage 5 and the carriage 5, together with the synchronous belt, moves in the main scanning direction T. The recording head 20 is provided in a lower portion of the carriage 5. A nozzle plate 21 is fixed to the lower surface of the recording head 20.

A recording paper sheet 22, or an ejection target, is a type of recording medium. Characters and images can be recorded on the recording paper sheet 22 by the ink ejected from the recording head 20. The recording paper sheet 22 can be transported by a non-illustrated paper sheet transport mechanism, for example, in a direction perpendicular to the main scanning direction T. The recording head 20 is an example of an ejection head that ejects liquid through nozzles and may be referred to as a printing head.

The liquid supply passage portion 40 is an ink supply path by which the ink is supplied from the ink cartridges 11A to 11H to the recording head 20. The liquid supply passage portion 40 has tubes 41 and pressure adjustment portions 43A to 43H located between the corresponding ink cartridges 11A to 11H and the recording head 20. Referring to FIG. 1, in the illustrated embodiment, eight liquid supply passage portions 40 are provided in parallel between eight ink cartridges 11A to 11H and the carriage 5 and the recording head 20.

Figure 2:
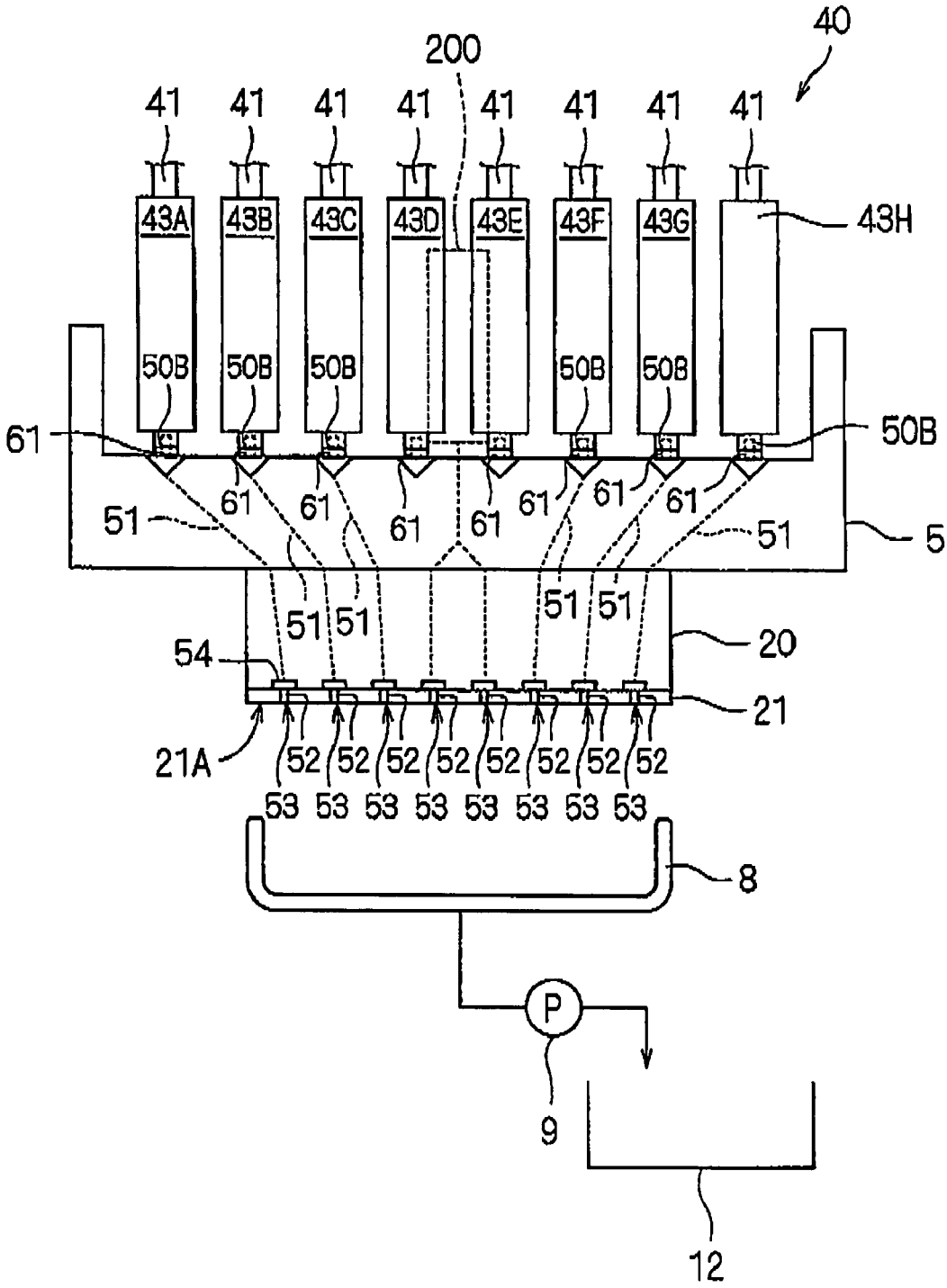
FIG. 2 is an enlarged view showing a liquid supply passage portion, a carriage, and a recording head.

FIG. 2 is an enlarged view showing the tubes 41 and the pressure adjustment portions 43A to 43H of the liquid supply passage portion 40, the carriage 5, and the recording head 20. The pressure adjustment portions 43A to 43H are a unit for adjusting the pressure of the ink when the ink is supplied from the ink cartridges 11A to 11H, each of which is a liquid retainer, to the recording head 20. A seal member 50B is arranged below each of the pressure adjustment portions 43A to 43H.

The carriage 5 and the recording head 20 have ink passages 51. The ink passages 51 connect the pressure adjustment portions 43A to 43H to a plurality of nozzle openings 52, or nozzles of the recording head 20. As viewed in FIG. 2, the nozzle openings 52 are aligned along a direction perpendicular to the sheet surface of FIG. 2. Each of the nozzle opening rows 53, or nozzle rows, is configured by a plurality of nozzle openings 52. The nozzle opening rows 53 are arranged parallel with each other along, for example, the direction perpendicular to the sheet surface of FIG. 2. The nozzle openings 52 are formed in a nozzle plate surface 21A of the nozzle plate 21. The nozzle openings 52 axe connected to a pressure chamber 54. The ink cartridges 11A to 11H retain liquid and supply the liquid to the recording head 20. The inks of the different colors are examples of the liquid.

Figure 4:
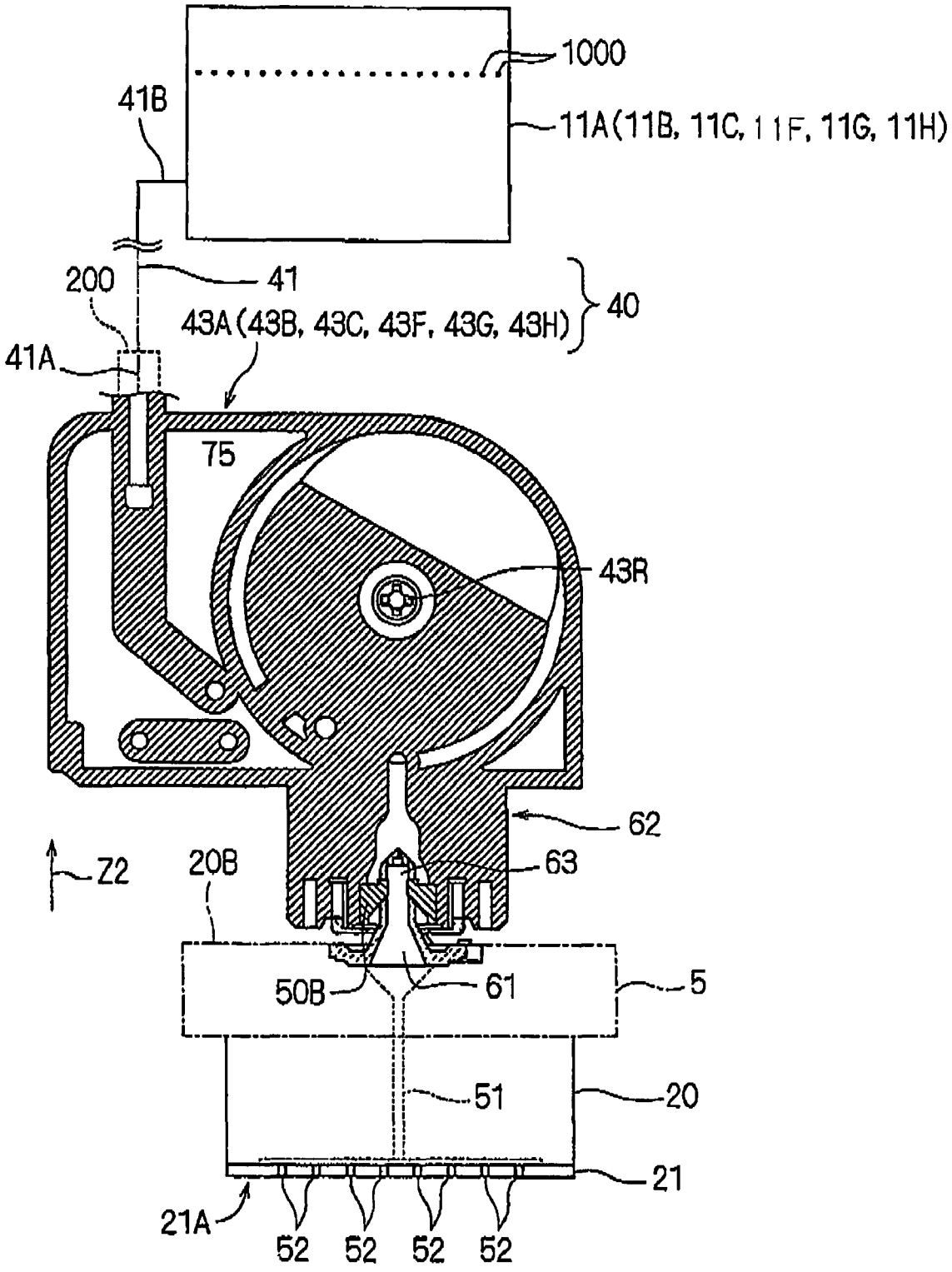
FIG. 4 is a view showing ink cartridges, the liquid supply passage portion, and a recording head.

FIG. 4 shows the six ink cartridges 11A, 11B, 11C, 11F, 11G, 11H, the liquid supply passage portion 40, a needle member 61, and the recording head 20. In FIG. 4, each of the ink cartridges 11A, 11B, 11C, 11F, 11G, 11H retains ink 1000. The ink 1000 flows from the ink cartridges 11A, 11B, 11C, 11F, 11G, 11H to the seal materials 50B through the flexible tubes 41 and the passage defined in the pressure adjustment portions 43A, 43B, 43C, 43F, 43G, 43H. A self-sealing valve (a depressurization valve) 43R is received in each of the pressure adjustment portions 43A, 43B, 43C, 43F, 43G, 43H. The self-sealing valves 43R operate to decrease and adjust the pressure of the ink 1000 that is sent from the ink cartridges 11A, 11B, 11C, 11F, 11G, 11H to the recording head 20 through the tubes 41 and the needle members 61.

When the carriage 5 accelerates or decelerates and the pressure of the ink 1000 in the tubes 41 varies, ejection of ink droplets becomes unstable. In this state, the pressure adjustment portions 43A, 43B, 43C, 43F, 43G, 43H suppresses such pressure variation of the ink 1000. An ink passage 63 is defined in a projecting portion 62 of each of the pressure adjustment portions 43A to 43H. The seal member 50B can be removably fitted in the lower end of each of the ink passages 63.

Each of the needle members 61 projects from an upper portion 20B of the recording head 20 in a second direction Z2 in FIG. 4, or toward the pressure adjustment portions 43A to 43H. The needle members 61 are each passed through the ink passage 63, as shown in FIG. 4. This structure supplies the ink 1000 from the ink cartridges 11A, 11B, 11C, 11F, 11G, 11H to the recording head 20 through the tubes 41, the pressure adjustment portions 43A, 435, 43C, 43F, 43G, 43H, and the ink passages 63.

Figure 3:
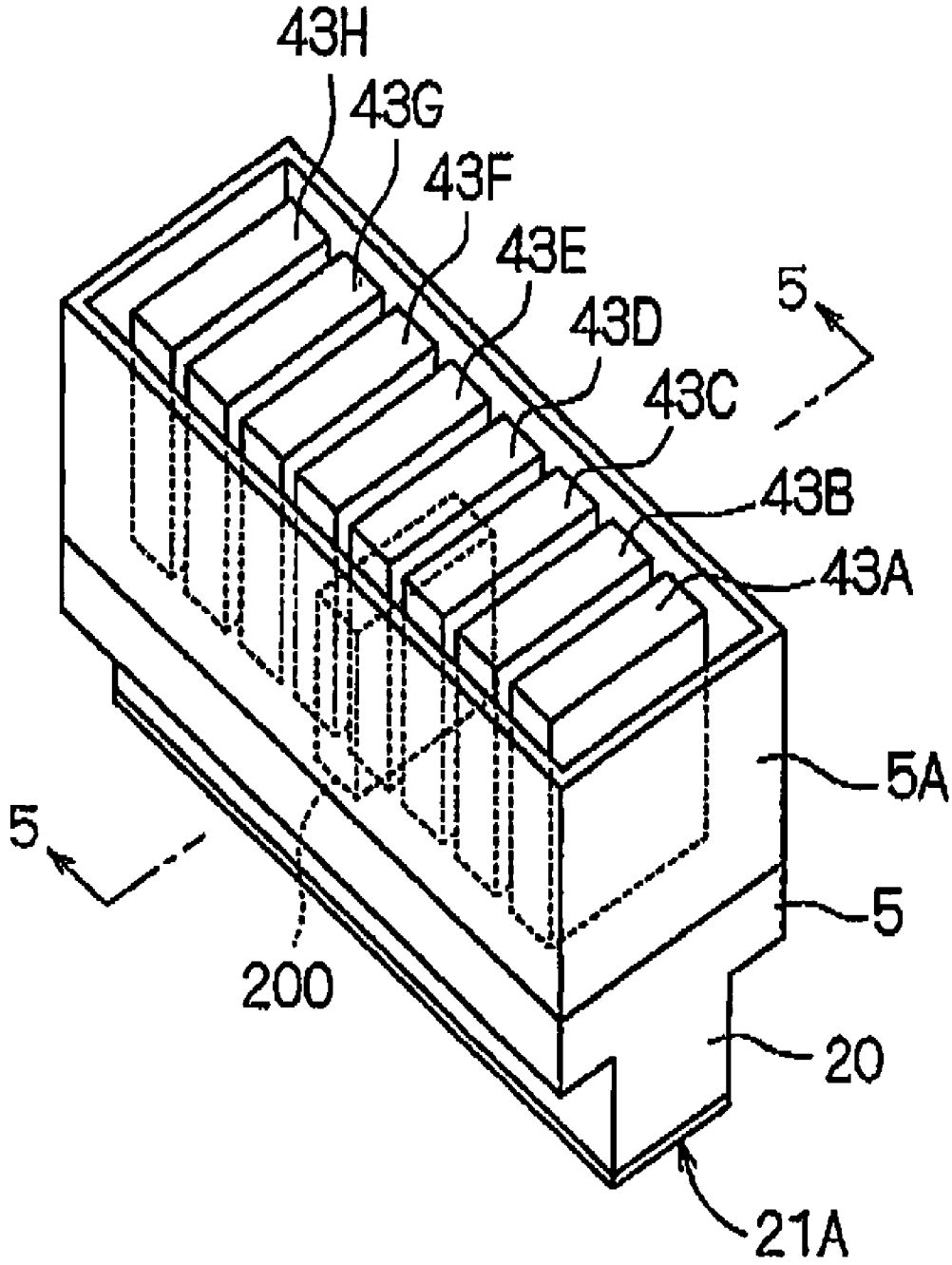
FIG. 3 is a perspective view showing an example of arrangement of the carriage, a pressure adjustment portion, and a liquid switching device.

As shown in FIGS. 1 to 3, a switching device 200 is mounted in the vicinity of the recording head 20, or, preferably, in the carriage 5. FIG. 3 shows the switching device 200, the pressure adjustment portions 43A to 43H, the carriage 5, and the recording head 20. The carriage 5 has a holder 5A. The holder 5A is a holding portion that accommodates the pressure adjustment portions 43A to 43H. The switching device 200 functions as a switching mechanism that switches liquid supplied to an ejection head from a plurality of types of liquid provided from a plurality of cartridges. In the illustrated embodiment, the switching device 200 is mounted in the holder 5A.

Referring to FIG. 2, a cap member 8, or a sealing member, a suction pump 9, and a waste liquid tank 12 are provided in a non-printing area defined on the movement path of the carriage 5. The cap member 8 is formed of flexible material, which is, for example, rubber. When the carriage 5 is located in the non-printing area, a nozzle plate surface 21A of the recording head 20 is sealed by the cap member 8. That is, the cap member 8 functions as a lid body that prevents dryness of the nozzle openings 52 of the recording head 20 when the body 1 is in a non-operating period.

The bottom surface of the cap member 8 is connected to the suction pump 9 through a tube. The space in the cap member 8 is subjected to suction by the suction pump 9 in such a manner that the negative pressure produced by the suction pump 9 acts on the recording head 20. In this manner, the ink is drained from the recording head 20. The cap member 8 in a printing area includes a wiping member (not shown), which is formed of elastic material such as rubber. This allows the cap member 8 to wipe and clean the nozzle plate surface 21A of the recording head 20 when necessary.

Figure 5:
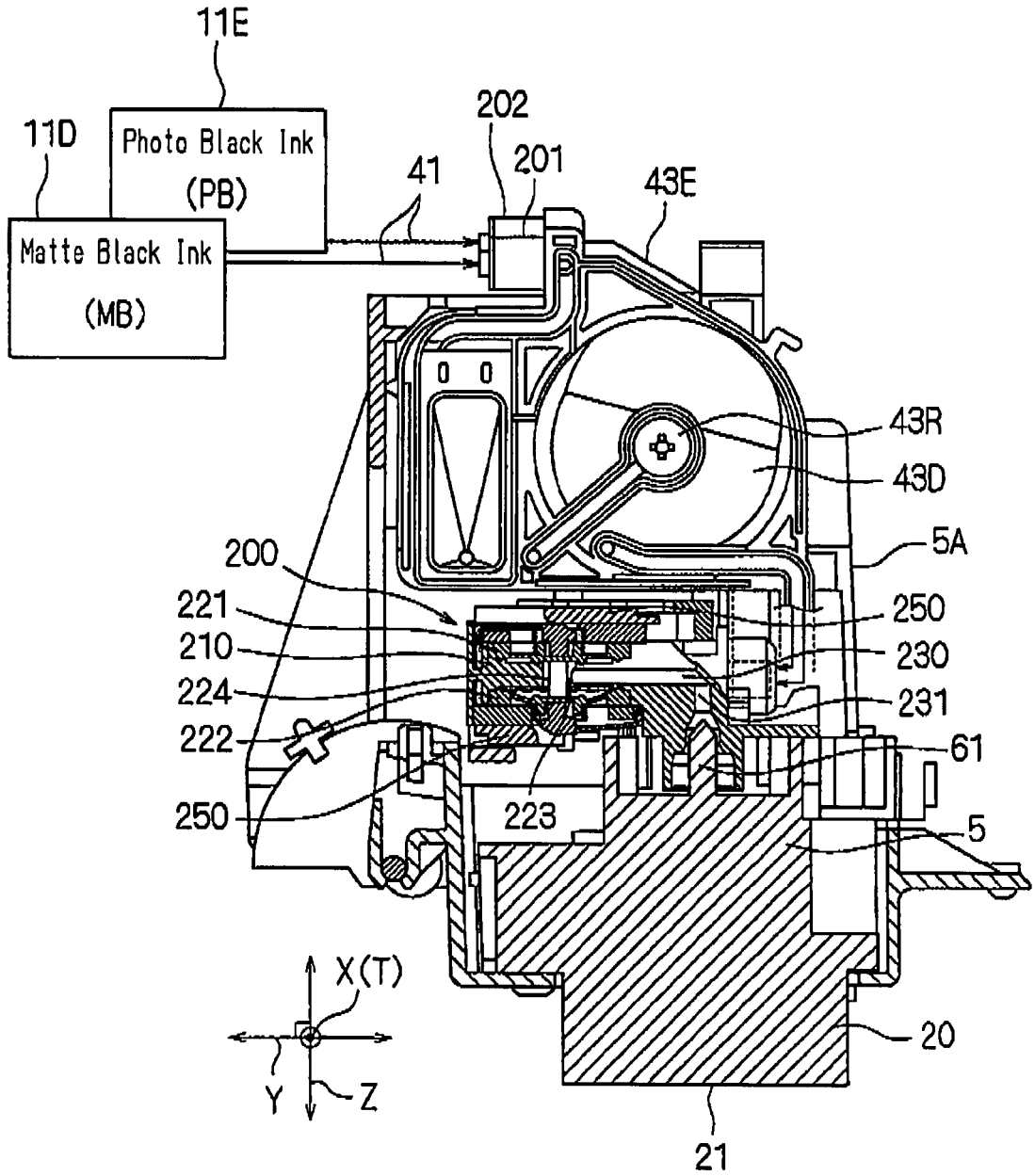
FIG. 5 is a cross-sectional view taken along line 5-5 of FIG. 3.

FIG. 5 shows the structure along the cross section taken along line 5-5 of FIG. 3. The pressure adjustment portions 43D, 43E are received in the holder 5A. As shown in FIGS. 1 and 3, the switching device 200 is arranged between, for example, the pressure adjustment portions 43D, 43E and above the carriage 5. In FIG. 5, direction Z extending in the up-and-down direction of the drawing, direction Y extending in the left-and-right direction of the drawing, and direction X extending perpendicular to the sheet surface of the drawing are defined as illustrated. Direction X extends in the same direction as the main scanning direction T in FIG. 1. The ink cartridge 11D retains the matte black ink MB and is connected to a connecting portion 201 of the pressure adjustment portion 43D through the corresponding tube 41. The ink cartridge 11E retains the photo black ink PB and is connected to a connecting portion 202 of the pressure adjustment portion 43E through the corresponding tube 41.

Figure 6:
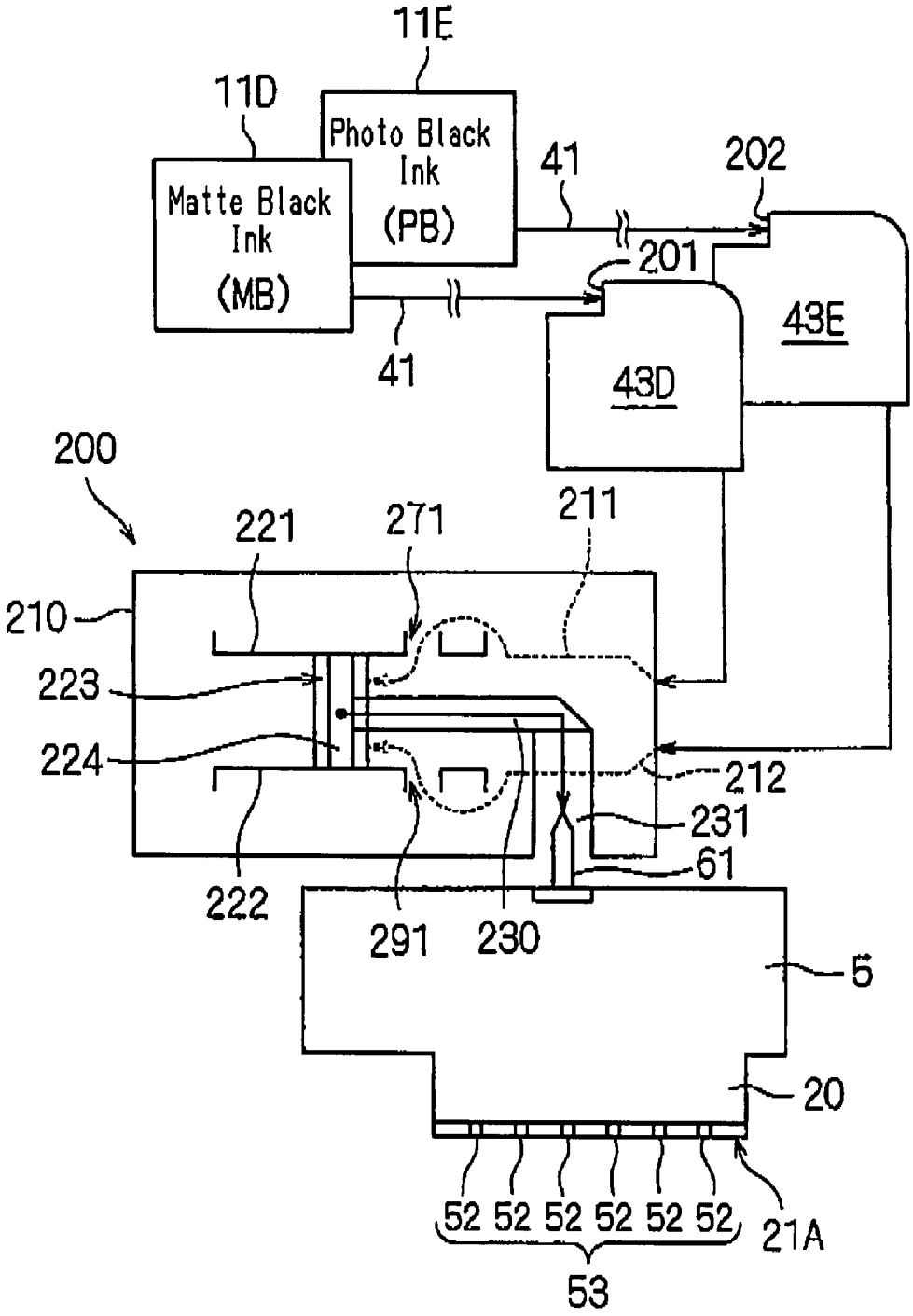
FIG. 6 is a view showing an ink passage in two types of ink cartridges, two pressure adjustment portions, the liquid switching device, and the recording head.

FIG. 6 shows connection paths extending from the ink cartridges 11D, 11E, which are shown in FIG. 5, to the two pressure adjustment portions 43D, 43E, the switching device 200, and the recording head 20 schematically for facilitating understanding. The pressure adjustment portion 43D is connected to a first diaphragm chamber of a first diaphragm 221 through a first passage portion 211 of a body 210 of the switching device 200. The pressure adjustment portion 43E is connected to a second diaphragm chamber of a second diaphragm 222 through a second passage portion 212 of the body 210. The first passage portion 211 is connected to a communication passage 223 through an ink inlet hole 271 of the first diaphragm 221. The second passage portion 212 is connected to the communication passage 223 through an ink inlet hole 291 of the second diaphragm 222.

The body 210 includes a line 230 and a line 231. The communication passage 223, together with the line 230 and the line 231, defines an ink passage and communicates with the recording head 20. The corresponding one of the needle members 61 is inserted into the line 231. The needle member 61 and the structure of the interior of the recording head 20 are shown in FIG. 4.

The first diaphragm 221 and the second diaphragm 222 of the switching device 200 selectively open and close the communication passage 223. This switches between the passage of the matte black ink MB of the ink cartridge 11D and the passage of the photo black ink PB of the ink cartridge 11E. This supplies one of the matte black ink MB or the photo black ink PB to the recording head 20 through the corresponding one of the needle members 61. The ink is then ejected from the nozzle openings 52 of the nozzle opening row 53.

Figure 7:
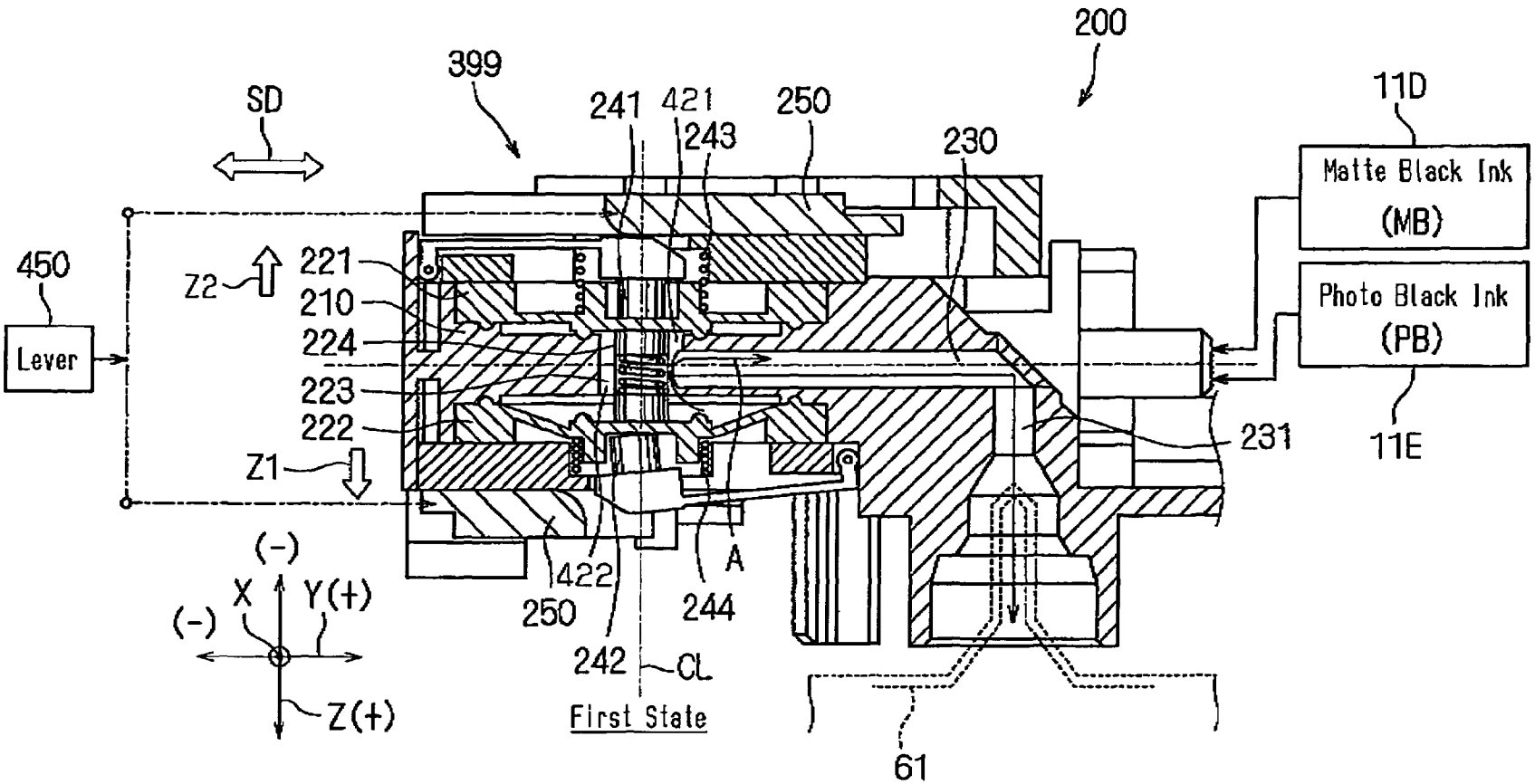
FIG. 7 is a view showing a first state in which a first diaphragm closes a communication passage and a second diaphragm opens the communication passage.

FIG. 7 shows, in detail, the configuration of the switching device 200 shown in FIGS. 5 and 6. FIG. 7 illustrates a first state in which the first diaphragm 221 closes one of a pair of openings of the communication passage 223 and the second diaphragm 222 opens the other opening. In a second state, contrastingly to the first state of FIG. 7, the second diaphragm 222 closes one of the openings of the communication passage 223 and the first diaphragm 221 opens the other opening. The first state and the second state will be described in detail later.

The configuration of the switching device 200 as the switching mechanism will hereafter be explained with reference to FIG. 7. The switching device 200 includes the body 210, the first diaphragm 221, the second diaphragm 222, an operation device 224 as an operation mechanism, a first pressing member 241, a second pressing member 242, first and second urging members 243, 244, and sliders 250. The body 210 has the lines 230, 231 and the communication passage 223, which communicates with the recording head 20. The needle members 61 are inserted into the lines 231.

Figure 8A:
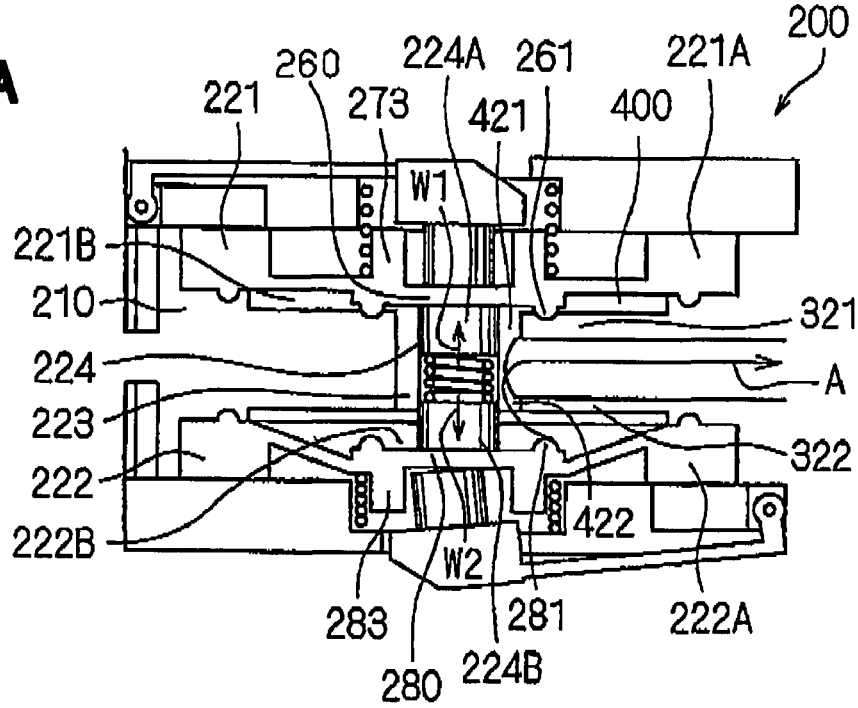
FIG. 8A is an enlarged view showing the vicinity of the communication passage.
Figure 9A:
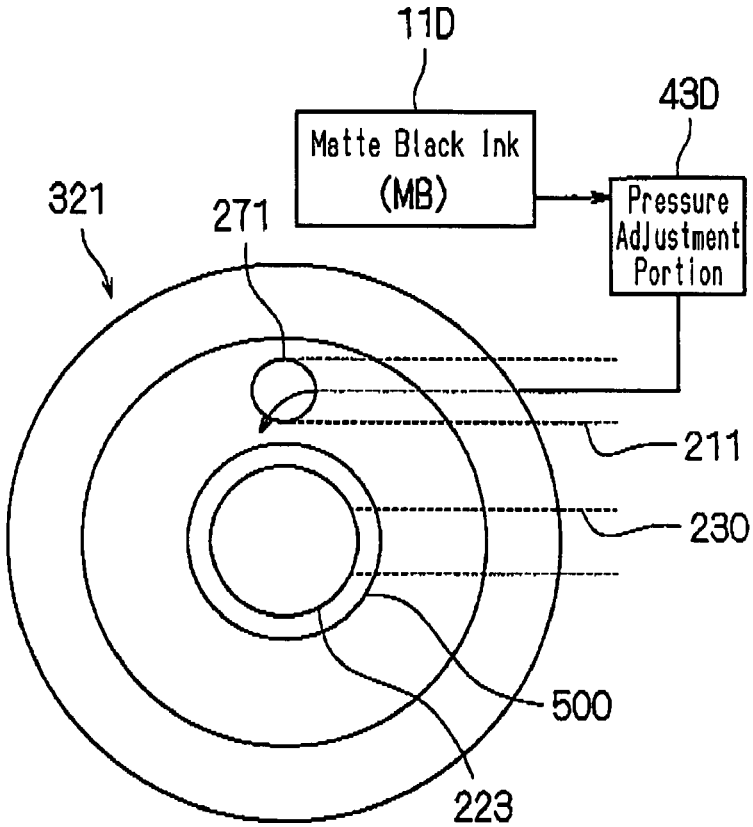
FIG. 9A is a view showing the first circumferential portion.
Figure 9B:
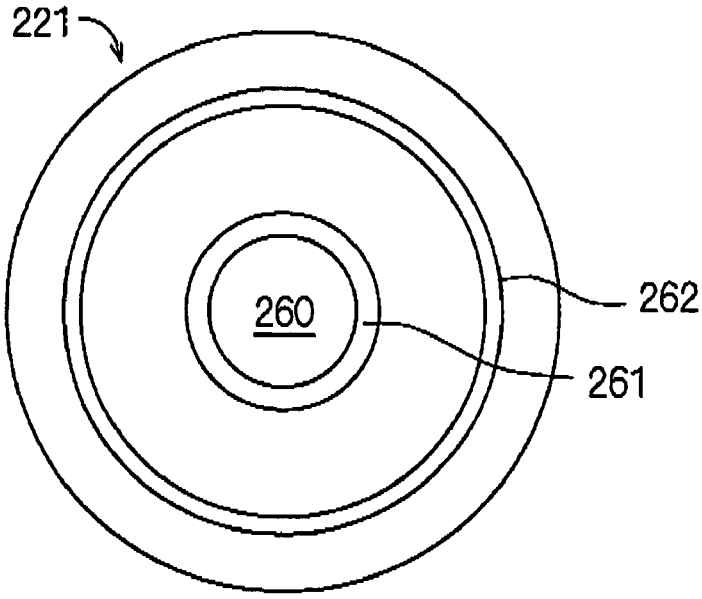
FIG. 9B is a view showing the first diagram.

The first diaphragm 221 is shaped identically to the second diaphragm 222. The first diaphragm 221 and the second diaphragm 222 are located at symmetrical positions in the up-and-down direction. FIG. 8A is an enlarged view showing the vicinity of the first diaphragm 221 and the second diaphragm 222, FIG. 9A shows the shape of a first circumferential portion 321 of the body 210, as viewed in direction W2 in FIG. 8A. FIG. 9B shows the shape of the first diaphragm 221 as viewed in direction W1 in FIG. 8A.

In the body 210, the first diaphragm 221 and the second diaphragm 222 communicate with each other through the communication passage 223 and are located in a first diaphragm chamber 221B and a second diaphragm chamber 222B, respectively. The first and second diaphragm chambers 221B, 222B are arranged to face each other. As shown in FIGS. 8A and 9B, the first diaphragm 221 has a thin disk-shaped film-like portion 260 and a first seal portion 261 held in tight contact with the first circumferential portion 321. The first seal portion 261 is an annular projection and the film-like portion 260 is formed inside the first seal portion 261.

Figure 8B:
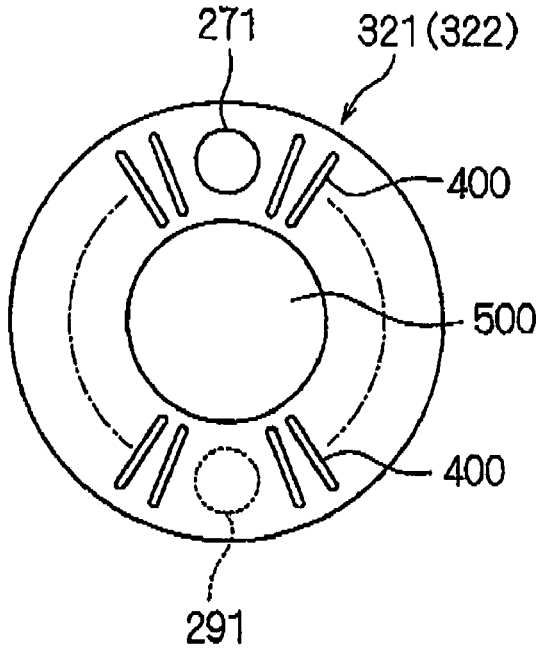
FIG. 8B is a view showing a first circumferential portion and a second circumferential portion.

With reference to FIG. 9B, an annular projection 262 is provided outside the first seal portion 261 of the first diaphragm 221. The first seal portion 261 selectively tightly contacts and separates from the first circumferential portion 321 of the body 210 by opening and closing the first diaphragm 221. Contrastingly, the projection 262 is constantly held in tight contact with the first circumferential portion 321. With reference to FIGS. 8A, 8B, and 9B, the ink inlet hole 271 is defined in the first circumferential portion 321 of the body 210 and between the position corresponding to the first seal portion 261 and the position corresponding to the projection 262. The ink inlet hole 271 introduces the ink from the pressure adjustment portion 43D to the communication passage 223 through the first diaphragm chamber 221B. Referring to FIG. 9A, an area 500 sealed by the first seal portion 261 is defined around the communication passage 223 in the first circumferential portion 321.

The second diaphragm 222 has a thin disk-shaped film-like portion 280 and a second seal portion 281 held in tight contact with a second circumferential portion 322. The second seal portion 281 is an annular projection and the film-like portion 280 is formed inside the second seal-portion 281. An annular projection is provided outside the second seal portion 281 of the second diaphragm 222. Through the opening and closing operation, the second seal portion 281 is caused to selectively tightly contact and separate from the second circumferential portion 322 of the body 210. Contrastingly, the projection is constantly held in tight contact with the second circumferential portion 322. An area 500 sealed by the second seal portion 281 is provided around the communication passage 223 in the second circumferential portion 322.

As indicated by the chain line in FIG. 8B, an ink inlet hole 291 is defined in the second circumferential portion 322 of the body 210 and at the position facing the ink inlet hole 271 through the area 500. The ink inlet hole 291 introduces the ink from the pressure adjustment portion 43E to the communication passage 223 through the second diaphragm chamber 222B.

The first diaphragm 221 and the second diaphragm 222 are formed of rubber material or plastic material or other types of material that are elastically deformable. As shown in FIG. 8A, a base 221A and a base 222A, which extend outwardly, are formed at the outer end of the first diaphragm 221 and the outer end of the second diaphragm 222, respectively. A projection 273 and a projection 283, which extend outwardly, are formed at the position corresponding to the film-like portion 260 in the first diaphragm 221 and the position corresponding to the film-like portion 280 in the second diaphragm 222, respectively.

The operation device 224 is provided in the communication passage 223 and opens the first diaphragm 221 and the second diaphragm 222. In other words, the operation device 224 opens the communication passage 223 by operating the first diaphragm 221 and the second diaphragm 222. A first operation end 224A of the operation device 224 is arranged in the first diaphragm chamber 221B and contacts the film-like portion 260. A second operation end 224B of the operation device 224 is arranged in the second diaphragm chamber 2225 and contacts the film-like portion 280. Referring to FIG. 7, the operation device 224 is arranged in the communication passage 223 to extend along the axis CL of the communication passage 223, or along direction Z in FIG. 7.

The first pressing member 241 presses the film-like portion 260 from outside in a first direction Z1 as viewed in FIG. 7. The second pressing member 242 presses the film-like portion 280 from outside in a second direction Z2 as viewed in FIG. 7. The first and second pressing members 241, 242 are allowed to wobble at a small angle about the respective support points. As shown in FIGS. 7 and 8A, a first urging member 243 is arranged around the first pressing member 241 and urges the film-like portion 260 in the first direction Z1. The first urging member 243 presses the first diaphragm 221 against the first circumferential portion 321, which is located around an opening communicating with the first diaphragm chamber 221B of the communication passage 223, to seal the opening. A second urging member 244 is arranged around the second pressing member 242 and urges the film-like portion 280 in the second direction Z2. The second urging member 244 presses the second diaphragm 222 against the second circumferential portion 322, which is located around an opening communicating with the second diaphragm chamber 222B of the communication passage 223, to seal the opening.

As illustrated in FIG. 8B, a plurality of grooves 400 are defined in the surface of the first circumferential portion 321 and the surface of the second circumferential portion 322, extending radially. The first circumferential portion 321 faces the first diaphragm 221 and tightly contacts the first diaphragm 221. The second circumferential portion 322 faces the second diaphragm 222 and tightly contacts the second diaphragm 222. The grooves 400 thus face the first diaphragm 221 or the second diaphragm 222.

The grooves 400 are defined in the first circumferential portion 321 and the second circumferential portion 322 for the following reason. Specifically, as shown in FIGS. 7 and 8A, when the surface of the first diaphragm 221 facing the first circumferential portion 321 is held in tight contact with the first circumferential portion 321, the grooves 400 prevent the first diaphragm 221 from becoming fixed in tight contact with the first circumferential portion 321. Similarly, when the surface of the second diaphragm 222 facing the second circumferential portion 322 is held in tight contact with the second circumferential portion 322, the grooves 400 prevent the second diaphragm 222 from becoming fixed in tight contact with the second circumferential portion 322. This allows the first diaphragm 221 and the second diaphragm 222 to smoothly and reliably open or close an opening 421 communicating with the first diaphragm chamber 221B and an opening 422 communicating with the second diaphragm chamber 222B in the communication passage 223. Alternatively, uneven portions may be formed in the surface of the first circumferential portion 321 and the surface of the second circumferential portion 322, instead of the grooves 400 shown in FIG. 8B.

The first pressing member 241, the second pressing member 242, and the sliders 250 form a switch operating portion 399 that operates the operation device 224 by pressing the first diaphragm 221 or the second diaphragm 222 to switch the open/closed state of each opening 421, 422 of the communication passage 223. In the switch operating portion 399, the first pressing member 241 presses the first diaphragm 221 against the opening 421 of the communication passage 223 to seal the communication passage 223. The second pressing member 242 presses the second diaphragm 222 against the opening 422 of the communication passage 223 to seal the communication passage 223. The sliders 250 slide in a sliding direction that passes through the position at which the sliders 250 contact the first pressing member 241 or the second pressing member 242 and the position at which the sliders 250 separate from the first pressing member 241 or the second pressing member 242. In this manner, the sliders 250 move the first pressing member 241 and the second pressing member 242 in the first direction Z1 or the second direction Z2. The first direction Z1 extends along the axis CL of the communication passage 223. The second direction Z2 extends along the axis CL of the communication passage 223 and in the direction opposite to the first direction Z1.

The sliders 250 are provided in the respective ones of the first pressing member 241 and the second pressing member 242. By manipulating a lever 450 connected to each of the sliders 250, the slider 250 is allowed to linearly reciprocate in a sliding direction SD shown in FIG. 7.

In the first state shown in FIG. 7, the slider 250 corresponding to the first pressing member 241 presses the first pressing member 241 in the first direction Z1 in FIG. 7. Contrastingly, in the second state, the slider 250 corresponding to the second pressing member 242 moves in direction Y(+) along the sliding direction SD in FIG. 7. This raises the second diaphragm 222 in direction Z2 in FIG. 7, instead of the first diaphragm 221. In this manner, through reciprocation of the levers 450 in the sliding direction SD, the opening 421 and the opening 422 of the communication passage 223 are alternately opened and closed through the first pressing member 241, the second pressing member 242, the first diaphragm 221, and the second diaphragm 222.

The first direction Z1 and the second direction Z2 along which the first pressing member 241 and the second pressing member 242 are moved through operation of the corresponding sliders 250 extend along the direction in which the communication passage 223 is opened by the first diaphragm 221 and the second diaphragm 222. The sliding direction SD of the sliders 250 extends substantially perpendicular to the first direction Z1 and the second direction Z2 of the first pressing member 241 and the second pressing member 242.

The levers 450 are preferably provided above the carriage 5, which is shown in FIG. 3. The levers 450 are manually operable by, for example, the operator. However, the present invention is not restricted to this. That is, sliding of the sliders 250 may be electrically brought about by, for example, an electromagnetic solenoid.

Figure 10A:
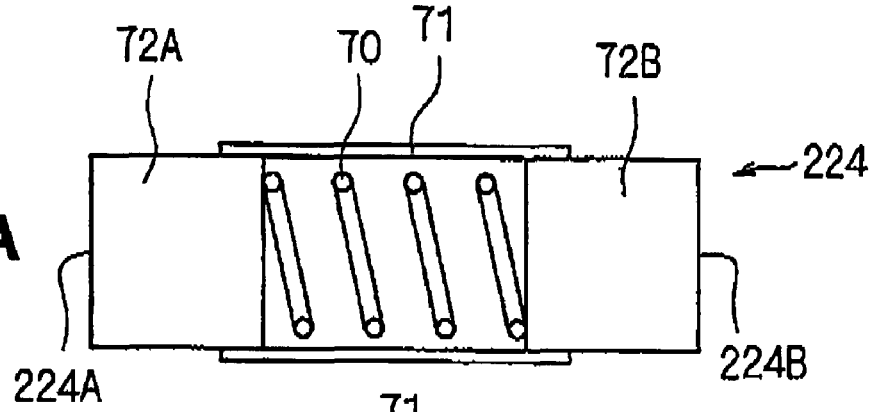
FIG. 10A is a view showing an operation device.
Figure 10B:
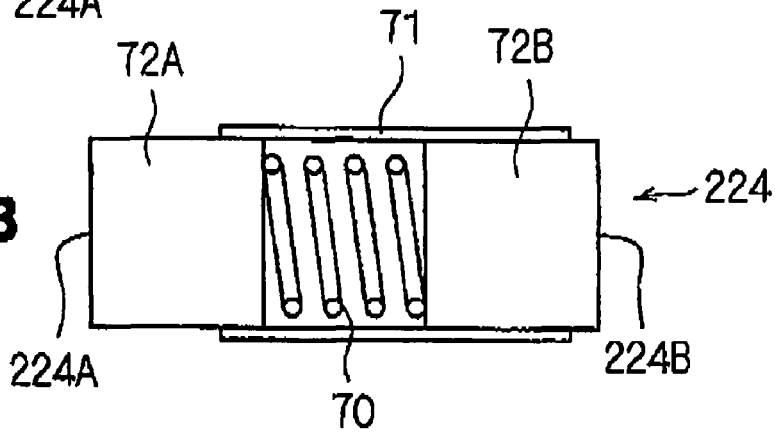
FIG. 10B is a view showing the operation device.

FIGS. 10A and 10B show the operation device 224. The operation device 224 has a pillar-like first operating portion 72A, a pillar-like second operating portion 723, and an urging member 70 arranged between the first and second operating portions 72A, 72B. One end of a cylindrical cover member 71, which covers the urging member 70, is secured to the first operating portion 72A. The second operating portion 72B is slidably received in the other end of the cover member 71 with the urging member 70 inserted in the cover member 71.

When the operation device 224 is compressed from the left and right as viewed in FIG. 10A, the second operating portion 72B slides in the cover member 71 and compresses the urging member 70, referring to FIG. 10B. In this state, a first operation end 224A that opens the opening 421 of the communication passage 223 against the force of the first diaphragm 221 and a second operation end 224B that opens the opening 422 of the communication passage 223 against the force of the second diaphragm 222 are urged in the opening direction of the first diaphragm 221 and the opening direction of the second diaphragm 222, or toward the first diaphragm 221 and the second diaphragm 222, respectively. The urging force of the urging member 70 of the operation device 224 is set to a value that is greater than the urging force of the first urging member 243 secured to the first diaphragm 221 and than the urging force of the second urging member 244 secured to the second diaphragm 222.

When the switching device 200 switches from one color of ink to another, the open/closed states of the opening 421 and the opening 422 of the communication passage 223 are switched through operation of the sliders 250. Further, the nozzle plate surface 21A of the recording head 20 is capped by the cap member 8 and the ink, which has been used, is drawn and drained from the nozzle openings 52 by the suction pump 9. This supplies unused ink from the ink cartridges to the recording head 20, thus replacing the ink in the recording head 20 and the passages.

Figure 11:
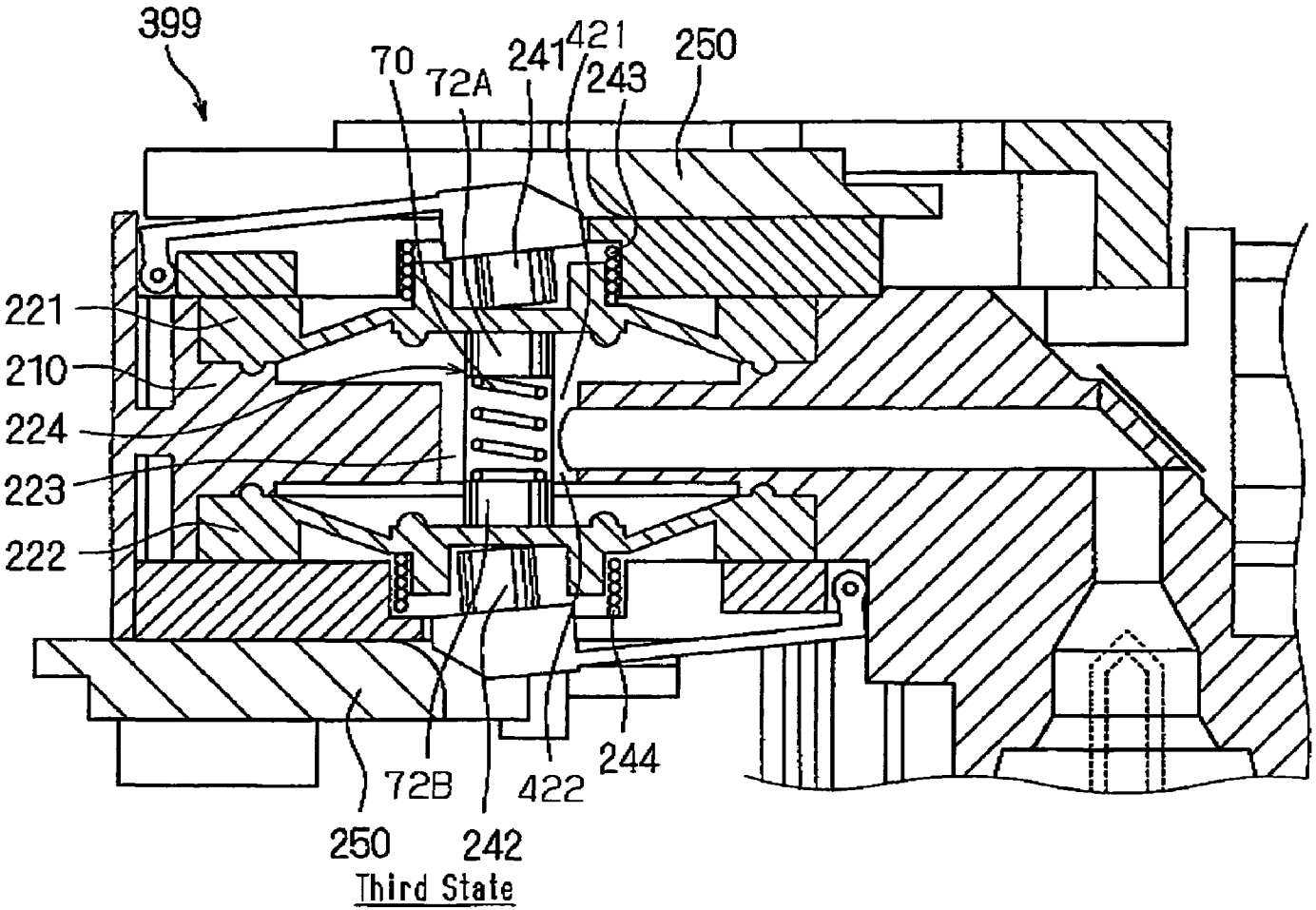
FIG. 11 is a view showing a third state, or an initial state, in which the first diaphragm and the second diaphragm open the communication passage.

Next, switching of ink by the switching device 200 will be explained. FIG. 11 shows an initial state of an inkjet type recording apparatus in which initial filling of ink from ink cartridges to a recording head and other passages is performed. The initial filling is carried out after the ink cartridges are initially mounted in the inkjet type recording apparatus. The initial state corresponds to a third state in which both of the openings 421, 422 of the communication passage 223 are maintained open, differently from the first and second states.

Figure 12:
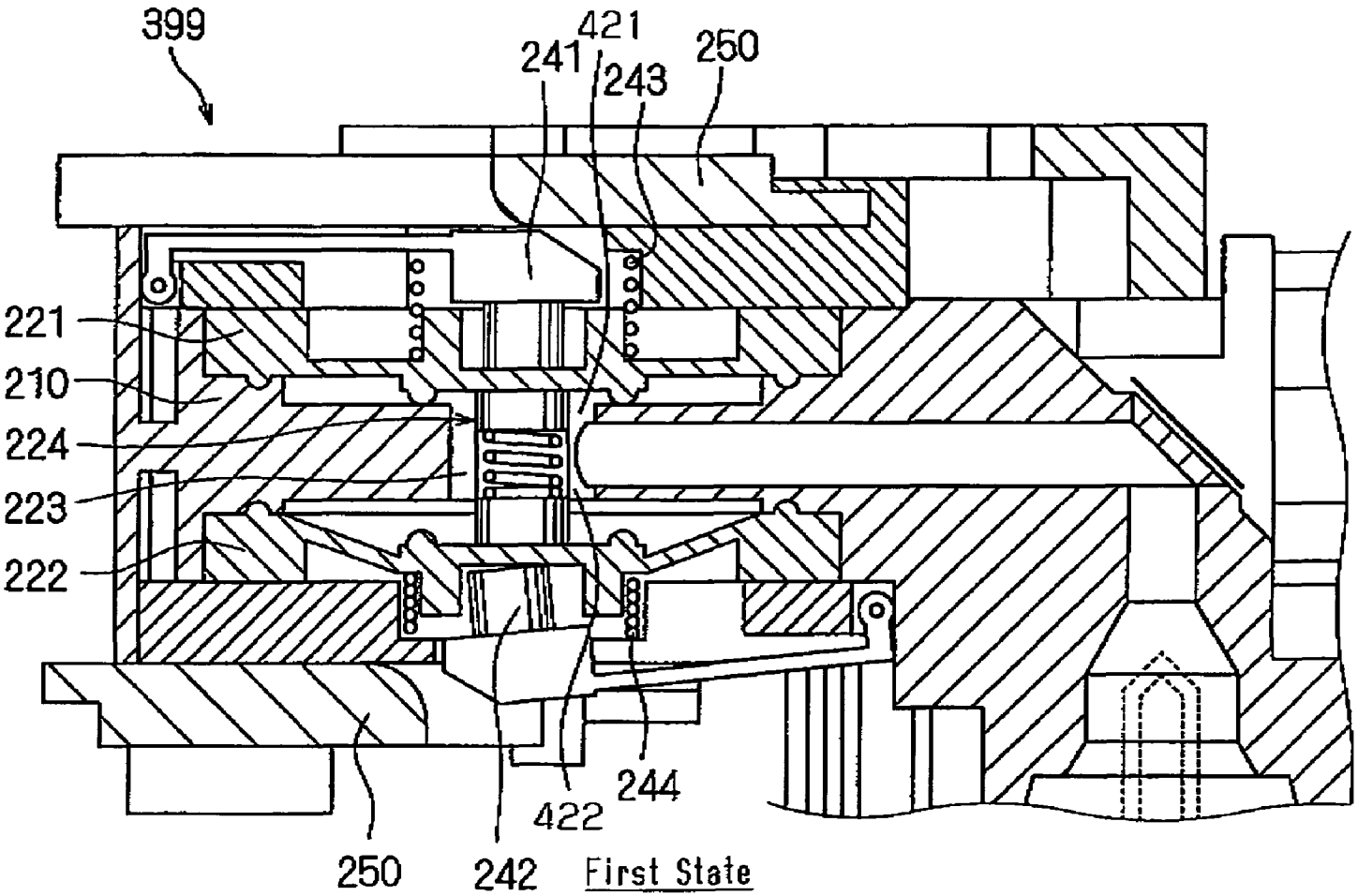
FIG. 12 is a view showing a first state in which a first diaphragm closes a communication passage and a second diaphragm opens the communication passage.
Figure 13:
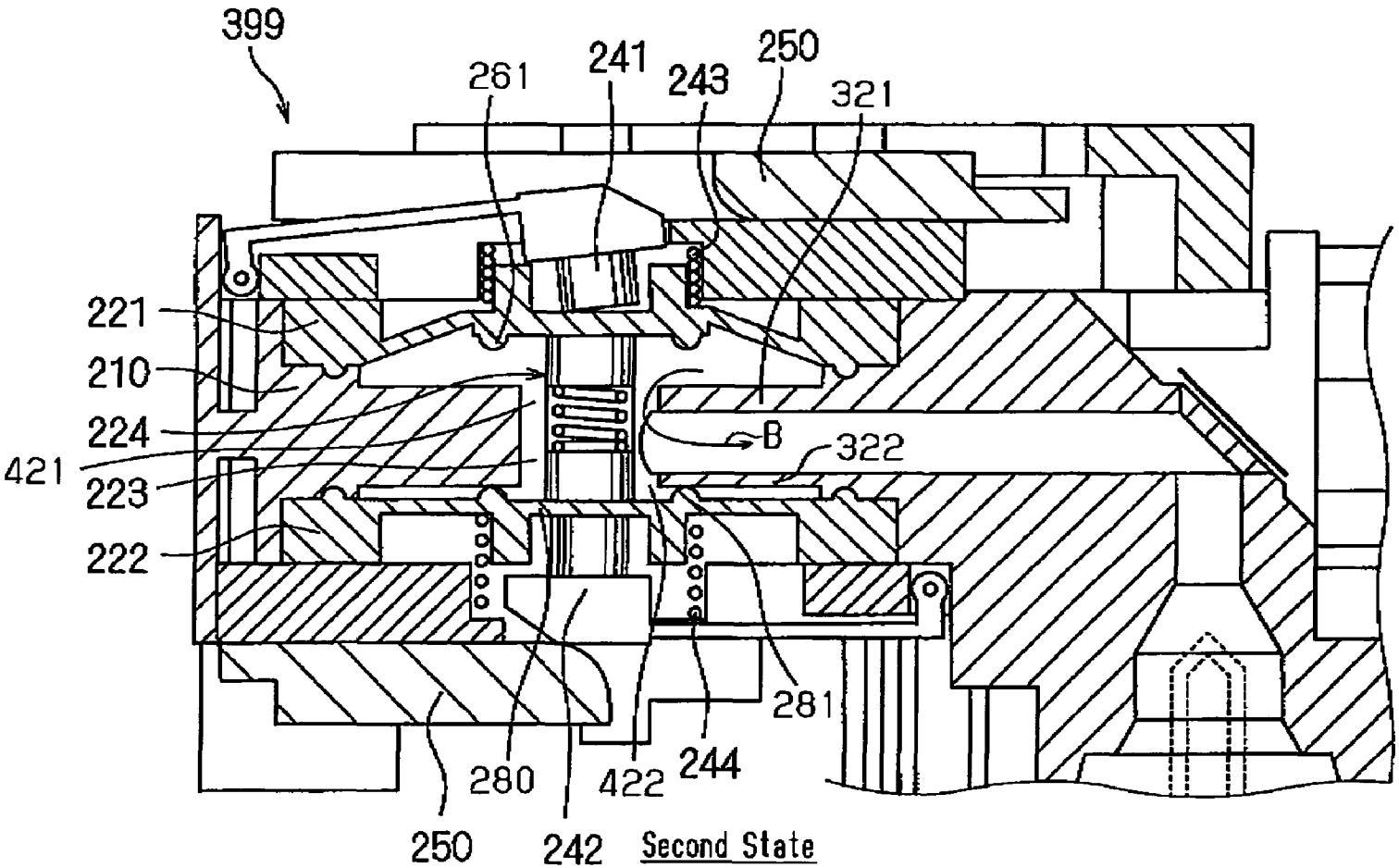
FIG. 13 is a view showing a second state in which the first diaphragm opens the communication passage and the second diaphragm closes the communication passage.

FIG. 12 illustrates the aforementioned first state in which the opening 421 is closed and the opening 422 is open in the communication passage 223. FIG. 13 illustrates the aforementioned second state in which the opening 421 is open and the opening 422 is closed in the communication passage 223. By switching between the first state and the second state, ink to be used is switched from one color to another.

First, the third state illustrated in FIG. 11 will be described. In this state, the sliders 250 are maintained at the positions at which the sliders 250 are not pressing, or separate from, the first pressing member 241 and the second pressing member 242. The urging member 70 of the operation device 224 urges the first operating portion 72A toward the first diaphragm 221 against the urging force of the first urging member 243 secured to the first diaphragm 221. The urging member 70 of the operation device 224 also urges the second operating portion 72B toward the second diaphragm 222 against the urging force of the second urging member 244 secured to the second diaphragm 222. As a result, the opening 421 and the opening 422 of the communication passage 223 become open.

When the ink cartridges 11D, 11E are installed in this state, the recording head 20 communicates with both of the ink cartridges 11D, 11E. At this stage, initial filling of ink to, for example, the recording head 20 and the passages in the pressure adjustment portions 43D, 43E is performed for initial use of the inkjet type recording apparatus 10 after installment of the ink cartridges 11D, 11E. Specifically, the nozzle plate surface 21A of the recording head 20 is capped by the cap member 8 and negative pressure is applied to the nozzle openings 52 by the suction pump 9. This introduces unused ink from the ink cartridges 11D, 11E into the recording head 20.

In such initial filling, the opening 421 and the opening 422 of the communication passage 223 are both open and the passages to the communication passage 223 are maintained open at the first and second diaphragms 221, 222. By applying negative pressure to the nozzle openings 52 with the ink cartridges 11D, 11E communicating with the recording head 20, the ink is supplied from the ink cartridges 11D, 11E to, for example, the passages in the recording head 20 and the pressure adjustment portions 43D, 43E. At this stage, the passage to the diaphragm chamber 221B and the passage to the diaphragm chamber 222B are filled solely with the ink of the corresponding ink cartridges 11D, 11E. However, the two colors of ink from the ink cartridges 11D, 11E are mixed, or maintained in a mixed color state, in the communication passage 223 and the recording head 20.

Therefore, after the initial filling is completed with the opening 421 and the opening 422 of the communication passage 223 maintained open, the opening facing the diaphragm corresponding to the ink cartridge retaining the ink that is not to be used afterward is closed. That is, solely the opening facing the diaphragm corresponding to the ink cartridge retaining the ink that is to be used afterward is maintained open. Suction is then performed to draw and discharge the ink in the mixed color state from the communication passage 223 and the recording head 20. Subsequently, the communication passage 223 and the recording head 20 are filled with the ink that is to be used afterward from the ink cartridge. At this stage, the inkjet type recording apparatus 10 becomes ready to use. When suction is repeated after the suction involved in the first filling, the amount and/or the time of suction become smaller than those in the initial filling.

Switching between the first state and the second state will hereafter be explained. Referring to FIG. 6, for example, each of the nozzle opening rows 53 of the recording head 20 includes the multiple nozzle openings 52. The following explanation starts with a case in which the photo black ink PB of the ink cartridge 11E is ejected from the nozzle openings 52 of the nozzle opening row 53.

In this case, referring to FIGS. 7 and 8A, one of the sliders 250 presses the first pressing member 241 in the first direction Z1 and the other one of the sliders 250 is separated from the second pressing member 242 to release the second pressing member 242. The first pressing member 241 presses the film-like portion 260 of the first diaphragm 221 in the first direction Z1 against the urging force of the first urging member 243. The operation device 224 is thus pressed also in the first direction Z1, causing the film-like portion 280 of the second diaphragm 222 to be pressed in the first direction Z1. This causes the film-like portion 260 of the first diaphragm 221 to reliably seal the opening 421 of the communication passage 223 using the first seal portion 261. That is, the first seal portion 261 contacts the first circumferential portion 321 of the communication passage 223.

Contrastingly, the film-like portion 280 of the second diaphragm 222 is pressed in the first direction Z1, separating the second seal portion 281 from the second circumferential portion 322. This maintains the opening 422 of the communication passage 223 in an open state. The direction indicated by arrow A in FIGS. 7 and 8A represents the ink flow direction of this state. In this manner, the photo black ink PB flows from the ink cartridge 11E to the communication passage 223 of the body 210 via the pressure adjustment portion 43E, the second passage portion 212 of the body 210, and the ink inlet hole 291. The photo black ink PB is then sent through the communication passage 223 and the lines 230, 231 and ejected from the nozzle opening 52 of the nozzle opening row 53 shown in FIG. 6 through the needle member 61.

The photo black ink PB is switched to the matte black ink MB in the following manner. Specifically, the sliders 250 are caused to slide in the sliding direction SD by manipulating the levers 450. The levers 450 press the second pressing member 242 in the second direction Z2 against the urging force of the second urging member 244 and release the first pressing member 241. Therefore, in the second state shown in FIG. 13, contrastingly to the first state shown in FIG. 7, the second seal portion 281 of the second diaphragm 222 contacts the second circumferential portion 322 of the communication passage 223. The film-like portion 280 thus seals the opening 422 of the communication passage 223. Contrastingly, the first seal portion 261 of the first diaphragm 221 is separated from the first circumferential portion 321 of the communication passage 223. The opening 421 of the communication passage 223 thus becomes open. The direction indicated by arrow B in FIG. 13 represents the ink flow direction of this state.

That is, the open/closed states of the opening 421 and the opening 422 of the communication passage 223 are maintained in states opposite to those of the first state. In this state, the matte black ink MB flows from the ink cartridge 11D to the communication passage 223 through the pressure adjustment portion 43D, the first passage portion 211 of the body 210, and the ink inlet hole 271. The matte black ink MB is then sent to the communication passage 223 and the lines 230, 231 and ejected from the nozzle opening 52 of the corresponding nozzle opening row 53 of the recording head 20 through the needle member 61.

Also in a case in which the matte black ink MB is switched to the photo black ink PB, the open/closed states of the first diaphragm 221 and the second diaphragm 222 are changed to switch the ink passages from one type of ink to another.

The illustrated embodiment has the following advantages.

In the illustrated embodiment, the switching device 200 is mounted in the portion close to the recording head 20, or, preferably, in the carriage 5. The switching device 200 switches from one ink passage to another. In other words, switching of different types of ink by switching from one ink passage to another is brought about in the vicinity of the recording head 20. Therefore, the embodiment has the following advantages.

If a switching device is arranged not at a position close to a recording head but at a position close to a plurality of ink cartridges and, for example, matte black ink is switched to photo black ink, the matte black ink remains in a long tube extending from the switching device to the recording head. The matte black ink thus must be discharged from the tube through forcible suction. That is, without such ink drainage, the matte black ink and the ink that is to be used afterward will be mixed. The forcible suction thus consumes the ink unnecessarily.

However, in the illustrated embodiment, since the switching device 200 is located close to the recording head 20, the amount of the ink drained in this manner decreases, thus reducing the consumption amount of the ink. Further, using the switching device 200, types of ink ejected from the nozzle openings 52 of the common nozzle opening row 53 can be reliably and easily switched from one type to another.

In the inkjet type recording apparatus 10 of the illustrated embodiment, types of ink flowing to the recording head 20 through the communication passage 223 can be switched from one type to another through movement of the first diaphragm 221 and the second diaphragm 222. Using the first diaphragm 221 and the second diaphragm 222, supply of different types of ink can be reliably stopped or brought about. Since supply of ink is permitted and prohibited by the diaphragms, leakage is prevented. The operation device 224 is capable of reliably and mechanically transmitting opening and closing operation of the first diaphragm 221 to the second diaphragm 222 as the opening and closing operation of the second diaphragm 222. The operation device 224 is received in the communication passage 223, which functions also as the ink passage. That is, since the first and second diaphragms 221, 222, or valve members, are received using the passage, the valve mechanism as a whole becomes compact.

One of the two openings 421, 422 of the communication passage 223 may be open when the other is closed. Further, the openings 421, 422 may become open at the same time. Therefore, for example, when initial filling is performed after the ink cartridges are first installed, both of the openings 421, 422 are opened to complete the initial filling for all of the ink cartridges by a single cycle of initial filling. In this case, unlike a conventional case, the initial filling does not have to be disadvantageously repeated for two cycles. Further, the two diaphragms 221, 222 face each other and the communication passage 223 between the diaphragms 221, 222 communicates with the recording head 20. This permits arrangement of the diaphragms 221, 222 close to each other and decreases the size of the space in the communication passage 223 in which different types of ink flows. The time spent for switching inks is thus shortened and the amount of the ink consumed for switching is decreased. Also, since the space in the communication passage 223 is reduced in size, there is little space left for retaining bubbles even if one of the ink cartridges is not used. This prevents a defect in ink ejection caused by the bubbles.

The switching device 200 has the switch operating portion 399, which operates the operation device 224 by pressing the first diaphragm 221 or the second diaphragm 222 to switch the open/closed states of the two openings 421, 422 of the communication passage 223. Therefore, using the first diaphragm 221 and the second diaphragm 222, supply of different types of liquid ink is reliably stopped or carried out. Since such supply of the ink is permitted and prohibited through the diaphragms 221, 222, liquid leakage is prevented.

The switching device 200 has the first urging member 243 and the second urging member 244. Therefore, even if intense negative pressure is produced in the body 210, the diaphragms 221, 222 are stably held in tight contact with the circumferential portions of the communication passage 223, maintaining a liquid-tight state.

The urging force of the urging member 70 of the operation device 224 is set to a value that is greater than the urging force of the first urging member 243 and than the urging force of the second urging member 244. Therefore, by releasing the pressing force applied to the first diaphragm 221 and the second diaphragm 222, the correspondingly released diaphragm is reliably opened against the urging force of the first or second urging member 243, 244. Opening and closing operation of the first and second diaphragms 221, 222 is thus reliably accomplished.

The grooves 400 or the uneven portions are provided in the first circumferential portions 321 and the second circumferential portion 322. Therefore, when the first diaphragm 221 or the second diaphragm 222 seals the corresponding circumferential portion of the communication passage 223, the first or second diaphragm 221, 222 is prevented from tightly contacting the circumferential portion of the communication passage 223.

The first diaphragm 221 has the first seal portion 261 that tightly contacts the first circumferential portion 321. The second diaphragm 222 has the second seal portion 281 that tightly contacts the second circumferential portion 322. The film-like portion 260 and the film-like portion 280 are formed inside the first seal portion 261 and the second seal portion 281, respectively. Therefore, even if the diaphragms 221, 222 receives intense negative pressure and the operation device 224 is moved slightly, the diaphragms 221, 222, which maintain the openings 421, 422 of the communication passage 223 in closed states, elastically deform and absorb the slight movement of the operation device 224. This prevents the movement of the operation device 224 from influencing the liquid-tight state of the seal portions 261, 281 of the diaphragms 221, 222, which maintain the openings 421, 422 in the closed state. That is, even if force acts on the operation device 224 to move the operation device 224 greatly, the force is transmitted to the sliders 250 through the pressing members 241, 242 that press the diaphragms 221, 222, suppressing movement of the operation device 224. The diaphragms 221, 222 thus maintain the liquid-tight state without moving greatly.

The switch operating portion 399 has the first pressing member 241, the second pressing member 242, and the sliders 250. Thus, simply by moving the sliders 250, opening and closing operation of the first diaphragm 221 and the second diaphragm 222 is carried out along the direction in which the communication passage 223 is opened or closed.

The sliding direction SD of the sliders 250 is substantially perpendicular to the first direction Z1 and the second direction Z2 of the first pressing member 241 and the second pressing member 242. Therefore, even if intense suction force acts on the nozzles of the recording head 20 and the nozzles receive negative pressure, an open one of the openings of the communication passage 223 is maintained in the open state. Accordingly, regardless of intense vibration or intense negative pressure produced in the body 210, the sliders 250 stably perform the opening and closing operation of the first diaphragm 221 and the second diaphragm 222.

The switching device 200 is arranged in the vicinity of the recording head 20. Therefore, when ink is switched from one type to another, only the ink remaining between the switching device 200 and the recording head 20 is drawn. Then, the ink is switched to a different type of ink, which is supplied to the recording head 20. This decreases the amount of the ink drained by switching ink types, suppressing unnecessary consumption of the ink. Different types of ink are thus reliably ejected from the common nozzles.

The switching device 200 is mounted in the carriage 5, which holds the recording head 20. Switching of ink is thus carried out in the vicinity of the recording head 20.

The carriage 5 has the levers 450 for moving the sliders 250 in the sliding direction SD. Sliding of the sliders 250 is thus reliably accomplished by the levers 450 in the carriage 5.

The switching device 200 is arranged in correspondence with the nozzle opening rows 53 defined in the recording head 20. This permits switching of ink to be used in accordance with the nozzle opening rows 53.

In the inkjet type recording apparatus 10 of the illustrated embodiment, the operation device 224 has the urging member 70 that urges the first operation end 224A and the second operation end 224B, which open the communication passage 223, toward the first diaphragm 221 and the second diaphragm 222, respectively. In the initial filling performed after the ink cartridges are first installed, the openings 421, 422 of the communication passage 223 are opened to complete the initial filling of all of the ink cartridges by a single cycle of initial filling.

The initial filling is carried out through suction with the openings 421, 422 of the communication passage 223 each maintained in an open state by the first and second diaphragms 221, 222, which are formed in the switching device 200. Then, the opening of the communication passage 223 corresponding to the ink cartridge retaining the ink that is not to be used afterward is closed. That is, the opening of the communication passage 223 corresponding to the ink cartridge retaining the ink that is to be used afterward is maintained in the open state. In this state, suction is performed to draw and drain the mixed ink from the passage from the ink cartridges to the recording head 20 and the interior of the recording head 20. The passage from the ink cartridges to the recording head 20 and the interior of the recording head 20 are then filled with the ink that is to be used afterward. The inkjet type recording apparatus 10 thus becomes ready to use.

The illustrated embodiments may be embodied in the following modified forms.

In the embodiments of the invention, switching between the matte black ink and the photo black ink is described, by way of example, as switching of different types of ink. However, the switching of the ink is not restricted to that of these embodiments but may be performed among other types of ink. For example, dye ink and pigment ink, as different types of ink, may be switched between each other, and other types of ink may be switched. Alternatively, switching is not restricted to switching between inks but may be switching between functional liquids other than ink, for example, cleansing liquid and moisturizing liquid or ink and functional liquid.

The off-carriage type inkjet type recording apparatus 10 shown in FIG. 1 has, for example, eight ink cartridges. However, the present invention is not restricted to this structure but may include two to seven or nine or more ink cartridges.

In each of the illustrated embodiments, the recording head 20 may be applied to a type of liquid ejection apparatus using a piezoelectric vibrator as a pressure generating element, which is a drive element that operates to eject liquid, or a type of liquid ejection apparatus using a heat generating element.

A program that executes a switching procedure and an initial filling method performed in the liquid ejection apparatus as has been described may be provided as data recorded in a recording medium or through a communication network.

A typical example of a liquid ejection apparatus is the inkjet type recording apparatus 10 including the above-described inkjet type recording head for recording images. However, the present invention may be applied to different types of liquid ejection apparatuses, such as an apparatus having a color material ejection head used in the manufacture of color filters of liquid crystal displays, an apparatus having an electrode material (conductive paste) ejection head used in the manufacture of electrodes of organic EL displays or surface emitting displays (FEDs), an apparatus having a bioorganic substance ejection head used in the manufacture of biochips, or an apparatus including a sample ejection head as a precision pipette, as other types of liquid ejection apparatuses.

The present invention is not limited to the illustrated embodiments but may be modified in various forms without departing from the scope of the claims. A part of each configuration of the illustrated embodiments may be omitted or the configurations may be combined as needed in a manner different from the above-described manners. Although the multiple embodiments have been described herein, it will be clear to those skilled in the art that the present invention may be embodied in different specific forms without departing from the spirit of the invention. The invention is not to be limited to the details given herein, but may be modified within the scope and equivalence of the appended claims.

The invention claimed is:

1. A liquid ejection apparatus comprising:

an ejection head including a nozzle in which liquid is ejected through the nozzle;

a plurality of cartridges that retain the liquid and supply liquid to the ejection head; and a switching mechanism that switches liquid to be supplied to the ejection head from a plurality of types of liquids supplied from the cartridges, the switching mechanism including:

a body having a communication passage in communication with the ejection head;

a first diaphragm chamber and a second diaphragm chamber that communicate with each other through the communication passage and located facing each other;

a first diaphragm and a second diaphragm arranged in the first diaphragm chamber and the second diaphragm chamber, respectively, the first diaphragm and the second diaphragm each being capable of opening and closing the communication passage; and an operation mechanism provided in the communication passage, the operation mechanism including:

a first operation end and a second operation end that operate the first diaphragm and the second diaphragm, respectively, when the communication passage is opened to allow communication between the ejection head and at least one of the first and second diaphragm chambers; and an urging member that urges the first and second operation ends in a direction in which the communication passage is opened by the first and second diaphragms, wherein the switching mechanism has a switch operating portion that switches an open/closed state of the communication passage by pressing the first diaphragm or the second diaphragm to operate the operation mechanism, wherein when the switching operating portion does not press the first diaphragm and the second diaphragm, the first and second chambers communicate with the ejection head, wherein the body includes:

a first circumferential portion arranged around one of a pair of openings of the communication passage and facing the first diaphragm; and a second circumferential portion arranged around the other opening of the communication passage and facing the second diaphragm, wherein the switching mechanism includes:

a first urging member that presses the first diaphragm against the first circumferential portion to seal the communication passage; and a second urging member that presses the second diaphragm against the second circumferential portion to seal the communication passage, and wherein urging force of the urging member of the operation mechanism is set to a value greater than urging force of the first urging member of the switching mechanism and also greater than urging force of the second urging member of the switching mechanism.

2. The liquid ejection apparatus according to claim 1, wherein the first circumferential portion and the second circumferential portion each have a groove or an uneven portion facing the first diaphragm or the second diaphragm.

3. The liquid ejection apparatus according to claim 2, wherein the first circumferential portion and the second circumferential portion each have a groove facing the first diaphragm or the second diaphragm.

4. The liquid ejection apparatus according to claim 1, wherein the first diaphragm includes:

a first seal portion held in tight contact with the first circumferential portion and having an annular shape; and a film-like portion formed inside the first seal portion, and the second diaphragm includes:

a second seal portion held in tight contact with the second circumferential portion and having an annular shape; and a film-like portion formed inside the second seal portion.

5. The liquid ejection apparatus according to claim 1, wherein the switch operating portion includes:

a first pressing member that presses the first diaphragm against one of a pair of openings of the communication passage to seal the communication passage;

a second pressing member that presses the second diaphragm against the other opening of the communication passage to seal the communication passage; and a slider that moves in a sliding direction passing through a position at which the slider contacts the first pressing member or the second pressing member and a position at which the slider separates from the first pressing member and the second pressing member, whereby moving the first pressing member or the second pressing member in a first direction or in a second direction, the first direction extending along the direction in which the communication passage is opened by the first diaphragm or the second diaphragm, the second direction extending along the direction in which the communication passage is opened and in a direction opposite to the first direction.

6. The liquid ejection apparatus according to claim 5, wherein the sliding direction of the slider is substantially perpendicular to the first direction and the second direction of the first pressing member and the second pressing member.

7. The liquid ejection apparatus according to claim 5, further comprising:

a carriage in which the ejection head is arranged; and a lever provided in the carriage for sliding the slider.

8. The liquid ejection apparatus according to claim 1, wherein the switching mechanism is arranged in the vicinity of the ejection head.

9. The liquid ejection apparatus according to claim 1, further comprising a carriage in which the ejection head is provided, wherein the switching mechanism is arranged in the carriage.

10. The liquid ejection apparatus according to claim 1, wherein the ejection head has a nozzle row including the nozzles, and wherein the switching mechanism is provided in correspondence with the nozzle row.

11. A liquid ejection apparatus comprising:

an ejection head including a nozzle in which liquid is ejected through the nozzle;

a plurality of cartridges that retain the liquid and supply liquid to the ejection head; and a switching mechanism that switches liquid to be supplied to the ejection head from a plurality of types of liquids supplied from the cartridges, the switching mechanism including:

a body having a communication passage in communication with the ejection head;

a first diaphragm chamber and a second diaphragm chamber that communicate with each other through the communication passage and located facing each other;

a first diaphragm and a second diaphragm arranged in the first diaphragm chamber and the second diaphragm chamber, respectively, the first diaphragm and the second diaphragm each being capable of opening and closing the communication passage; and an operation mechanism provided in the communication passage, the operation mechanism including:

a first operation end and a second operation end that operate the first diaphragm and the second diaphragm, respectively, when the communication passage is opened to allow communication between the ejection head and at least one of the first and second diaphragm chambers; and an urging member that urges the first and second operation ends in a direction in which the communication passage is opened by the first and second diaphragms, wherein the body includes:

a first circumferential portion arranged around one of a pair of openings of the communication passage and facing the first diaphragm; and a second circumferential portion arranged around the other opening of the communication passage and facing the second diaphragm, and the switching mechanism includes:

a first urging member that presses the first diaphragm against the first circumferential portion to seal the communication passage; and a second urging member that presses the second diaphragm against the second circumferential portion to seal the communication passage, and wherein urging force of the urging member of the operation mechanism is set to a value greater than urging force of the first urging member of the switching mechanism and also greater than urging force of the second urging member of the switching mechanism.

12. The liquid ejection apparatus according to claim 11, wherein the first circumferential portion and the second circumferential portion each have a groove or an uneven portion facing the first diaphragm or the second diaphragm.

13. The liquid ejection apparatus according to claim 11, wherein the first diaphragm includes:

a first seal portion held in tight contact with the first circumferential portion and having an annular shape; and a film-like portion formed inside the first seal portion, and the second diaphragm includes:

a second seal portion held in tight contact with the second circumferential portion and having an annular shape; and a film-like portion formed inside the second seal portion.

14. A liquid ejection apparatus comprising:

an ejection head including a nozzle in which liquid is ejected through the nozzle;

a plurality of cartridges that retain the liquid and supply liquid to the ejection head; and a switching mechanism that switches liquid to be supplied to the ejection head from a plurality of types of liquids supplied from the cartridges, the switching mechanism including:

a body having a communication passage in communication with the ejection head;

a first diaphragm chamber having a first diaphragm and a second diaphragm chamber having a second diaphragm, wherein the first and second diaphragm chambers communicate with the communication passage and are located facing each other; and a first pressing member and a second pressing member selectively located between a state in which one of the first and second pressing members presses corresponding one of the first and second diaphragms to communicate the communication passage with the corresponding one of the first and second diagram chambers and a state in which the first and second pressing members do not press the first and second diaphragms to communicate the communication passage with the first and second diaphragm chambers.

15. The liquid ejection apparatus according to claim 14, wherein the apparatus includes:

a first state in which the first pressing member presses the first diaphragm so that the second diaphragm chamber communicates with the ejection head;

a second state in which the second pressing member presses the second diaphragm so that the first diaphragm chamber communicates with the ejection head; and a third state in which the first pressing member and second pressing members do not press the first diaphragm and the second diaphragm, respectively, and the first diaphragm chamber and the second diaphragm chamber communicate with the ejection head.

* * * * *